US005275339A

United States Patent [19]

Andis et al.

[11] Patent Number: 5,275,339

[45] Date of Patent: Jan. 4, 1994

[54] DIFFUSER FOR HAIR DRYER

[75] Inventors: Matthew L. Andis, Racine, Wis.; Albert Wan, Tsuen Wan, Hong Kong

[73] Assignee: Andis Company, Racine, Wis.

[21] Appl. No.: 988,726

[22] Filed: Dec. 10, 1992

[51] Int. Cl.[5] ..... A45D 20/12

[52] U.S. Cl. ..... 239/443; 239/455; 239/504; 239/562; 34/97; 34/98

[58] Field of Search ..... 239/443, 455, 499, 504, 505, 239/507, 513, 556, 558-562, 135; 219/222; 392/384, 385, 454/298, 324; 34/96, 97, 98

[56] References Cited

U.S. PATENT DOCUMENTS

| | | | |
|---|---|---|---|
| 1,758,339 | 5/1930 | Wager . | |
| 2,443,071 | 6/1948 | Honerkamp et al. | 137/625.31 |
| 2,466,851 | 4/1949 | Honerkamp et al. | 454/324 |
| 3,943,329 | 3/1976 | Hlavac | 34/96 |
| 4,097,722 | 6/1978 | Soler et al. | 34/97 |
| 4,230,279 | 10/1980 | Forsberg | 34/97 |
| 4,525,623 | 6/1985 | Da Silva | 392/385 |
| 4,538,362 | 9/1985 | Andis | 34/97 |
| 4,602,146 | 7/1986 | Barns et al. | 392/384 |
| 4,848,007 | 7/1989 | Montagnino | 34/97 |
| 4,977,306 | 12/1990 | Kosaka et al. | 392/384 |
| 5,120,274 | 6/1992 | Zeller | 454/298 |
| 5,157,757 | 10/1992 | McDougall | 239/455 |

FOREIGN PATENT DOCUMENTS

| | | | |
|---|---|---|---|
| 2728406 | 1/1979 | Fed. Rep. of Germany | 34/96 |

*Primary Examiner*—Karen B. Merritt
*Attorney, Agent, or Firm*—Michael, Best & Friedrich

[57] ABSTRACT

A diffuser for a hair dryer having an air discharge nozzle, the diffuser comprising a body having a side wall defining a first opening adapted to communicate with the nozzle and a second opening. The body defines an air passage communicable between the first and second openings for conducting therebetween an air flow. Also included is a grill overlying the second opening and defining a plurality of discharge openings, and a plurality of generally hollow fingers extending from the grill outwardly of the air passage. The fingers define respective finger discharge openings and respective finger discharge passage portions communicable between the air passage and the finger discharge openings. In addition there is included a valve for selectively and adjustably controlling the flow of air from the air passage through the discharge openings and the finger discharge openings.

18 Claims, 3 Drawing Sheets

DIFFUSER FOR HAIR DRYER

BACKGROUND OF THE INVENTION

1. Technical Field

The invention relates generally to hair dryers and, more particularly, to diffusers for reducing the velocity of the airflow discharged from a hair dryer.

2. Related Prior Art

It is generally known to provide a hair dryer having a nozzle with a diffuser or similar attachment for spreading or enlarging the airstream produced by the hair dryer and discharged through the nozzle. It is also known to provide such diffusers to reduce the velocity of the airstream. U.S. Pat. No. 4,230,279, which issued to Forsberg on Oct. 28, 1980, discloses one such diffuser.

It is also generally known to provide a hair dryer with an adjustable damper for controlling the velocity of the discharged airstream. U.S. Pat. No. 4,097,722, which issued to Soler, et al. on Jun. 27, 1978, illustrates an example of such an adjustable hair dryer discharge control mechanism.

Attention is also directed to the following U.S. Pat. Nos.:

| | | |
|---|---|---|
| 1,758,339 | Wager | May 13, 1930 |
| 2,443,071 | Honerkamp, et al, | June 8, 1948 |
| 3,943,329 | Hlavac | March 9, 1978 |

SUMMARY OF THE INVENTION

According to one aspect, the invention comprises a diffuser for a hair dryer having an air discharge nozzle, the diffuser comprising a body having a side wall defining a first opening adapted to communicate with the nozzle and a second opening, the body defining an air passage communicable between the first and second openings for conducting therebetween an air flow, a grill overlying the second opening and defining a plurality of discharge openings, a plurality of generally hollow fingers extending from the grill outwardly of the air passage, the fingers defining respective finger discharge openings and respective finger discharge passage portions communicable between the air passage and the finger discharge openings, and valve means for selectively and adjustably controlling the flow of air from the air passage through the discharge openings and the finger discharge openings.

According to another aspect, the invention comprises a diffuser for a hair dryer having an air discharge nozzle, the diffuser comprising a body adapted to be supported on the discharge nozzle and having a side wall defining an opening and a first exterior surface adjacent the opening, a grill fixed to the body and extending across the opening, a valve member located between the body and the grill and providing a second exterior surface flush to and adjacent the first exterior surface that can be gripped by a user of the hair dryer, and means for supporting the valve member to afford selective relative movement by the user of the second exterior surface relative to the first exterior surface.

According to another aspect, the invention comprises a diffuser for a hair dryer having an air discharge nozzle, the diffuser comprising a body having an open end and an air passage communicable with the nozzle for conducting an air flow to the open end, a grill overlying the open end and including a plurality of spokes defining therebetween a plurality of air discharge openings, a plurality of generally hollow fingers on the grill and extending outwardly of the air passage, each finger having a finger discharge opening and a discharge passage portion communicable between the air passage and the finger discharge opening for conducting a portion of the air flow and, valve means located between the body and the grill for selectively and adjustably controlling the air flow through the fingers.

DETAILED DESCRIPTION OF THE PREFERRED EMBODIMENT

Figure 3:
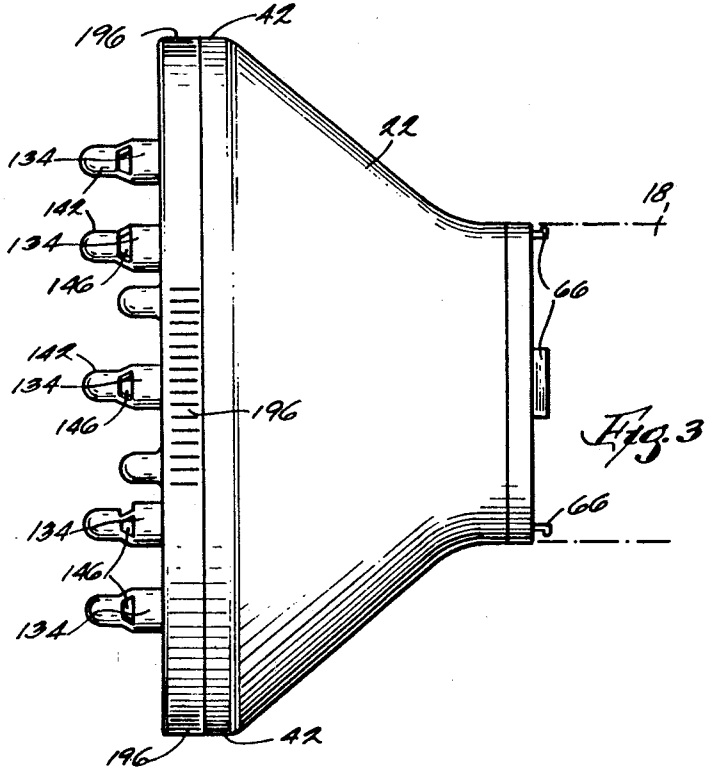
FIG. 3 is a side elevation view of the diffuser shown in FIG. 2.

The drawings illustrate a diffuser 10 for use on a conventional hair dryer 14 including a discharge nozzle 18 (shown in phantom in FIG. 3). The hair dryer 14 is operable to produce an airflow discharged through the nozzle 18.

The diffuser 10 is mounted on the discharge nozzle 18 to reduce the velocity of the airflow by enlarging the cross-sectional area of the airflow from the hair dryer 14. The diffuser 10 is preferably fabricated of heat-resistant plastic or a similar material and includes a bell-shaped housing or body 22. The body 22 includes (FIG. 6) an imperforate side wall 26 extending circumferentially about an axis and having an inner surface and an outer surface. The side wall 26 defines a first, generally circular and small opening 30 at one end of the body 22. For reasons discussed below, the side wall 26 also defines an inwardly turned step or shoulder 34 located adjacent the first opening 30.

The side wall 26 also defines a second, larger generally circular exhaust opening 38 at the other end of the body 22. For reasons discussed below, the side wall 26 provides (FIGS. 3 and 9) a first exterior surface 42 extending about the periphery of the exhaust opening 38. The side wall 26 also provides (FIG. 6) a stepped end 46 adjacent the exhaust opening 38. The diffuser body 22 and side wall 26 also define an air passage 50 communicable between the first and second openings 30, 38 for conducting therebetween the airflow from the nozzle 18.

The diffuser 10 is adapted to be mounted on the nozzle 18 by (FIG. 6) an extension joint 54 fixed to the diffuser body 22 and removably attached to the nozzle 18 in a conventional manner. More particularly, the extension joint 54 has a generally cylindrical wall 58 that is telescopically received by the first opening 30 in the body 22. A plurality of resiliently deflectable clips 62 are circumferentially distributed around the cylindrical wall 58 and have radially outwardly splayed ends. The clips 62 engage the shoulder 34 adjacent the first opening 30 and lock the extension joint 54 to the diffuser body 22. A plurality of tabs 66 (shown in FIGS. 3 and 6) are located on the cylindrical wall 58 outside the body 22. The tabs 66 extend into, and are engaged by, the discharge nozzle 18 in a conventional manner so that the diffuser 10 is removably supported by the nozzle 18.

The diffuser 10 also includes (FIGS. 2, 5 and 6) a grill 70 that is fixed to the body 22 in a position overlying the exhaust opening 38. The grill 70 divides the exhaust opening 38 into an annular, radially outer discharge area 74 and a generally circular, radially inner valved discharge area 78. While various constructions for the grill 70 can be used, the illustrated grill 70 includes (FIG. 2) a centrally located, imperforate hub cap 82 and a pair of generally annular inner and outer rings 86, 90 that are concentrically arranged about the hub cap 82. A cylindrical shank 94 (FIGS. 6 and 8) extends from the hub cap 82 axially inwardly of the diffuser body 22. The outer surface of the shank 94 is stepped so that the distal or axially inner end 98 of the shank 94 has a circumference that is smaller than that of the portion of the shank 94 adjacent the hub cap 82.

Figure 6:
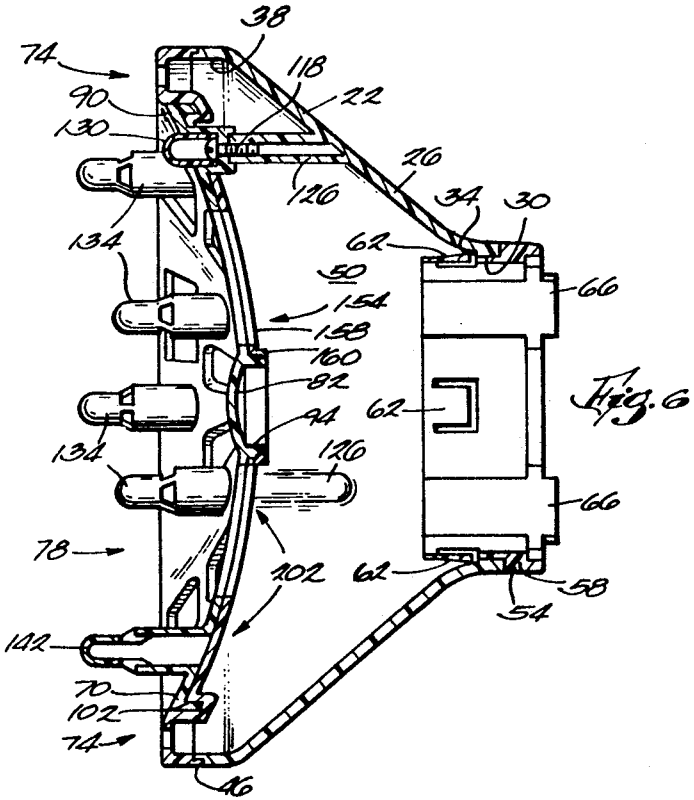
FIG. 6 is a cross-sectional view taken along line 6—6 in FIG. 5.

As shown in FIG. 6, the circumference of the grill 70 is smaller than that of the exhaust opening 38. As a result, the grill 70 and the portion of the side wall 26 adjacent the exhaust opening 38 define therebetween the radially outer discharge area 74.

Figure 2:
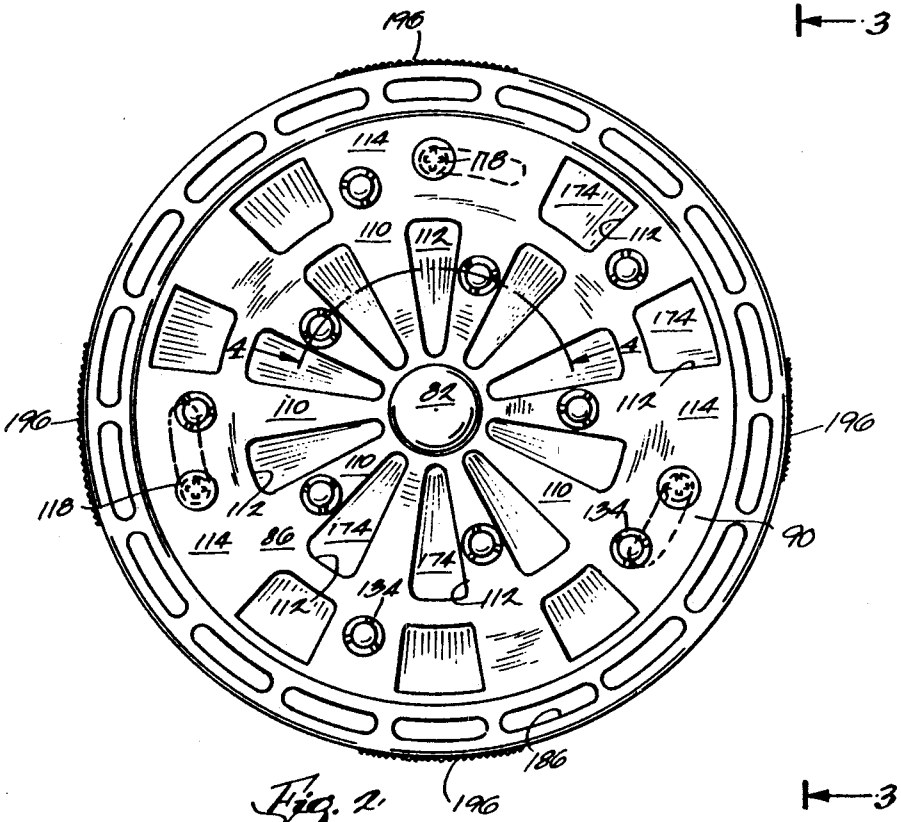
FIG. 2 is an enlarged, front view of the diffuser shown in FIG. 1.

The grill 70 also includes (FIG. 2) a series of circumferentially spaced spokes 110 that extend radially from the hub cap 82 past the inner ring 86 to the outer ring 90. Preferably, the spokes 110 increase in circumferential width with increasing radial distance from the hub cap 82. In the embodiment of the diffuser 10 shown in the drawings, the spokes 110 are equi-angularly spaced about the hub cap 82. As a result of the spacing of the spokes 110, the spokes 110 subdivide the radially inner valved discharge area 78 into (FIGS. 2 and 4) a plurality of radially inner discharge openings 112. As best shown in FIG. 2, the grill 70 also includes a series of imperforate regions 114 that are circumferentially spaced-apart, that are located radially outside the inner ring 86, and that extend between adjacent spokes 110.

Figure 5:
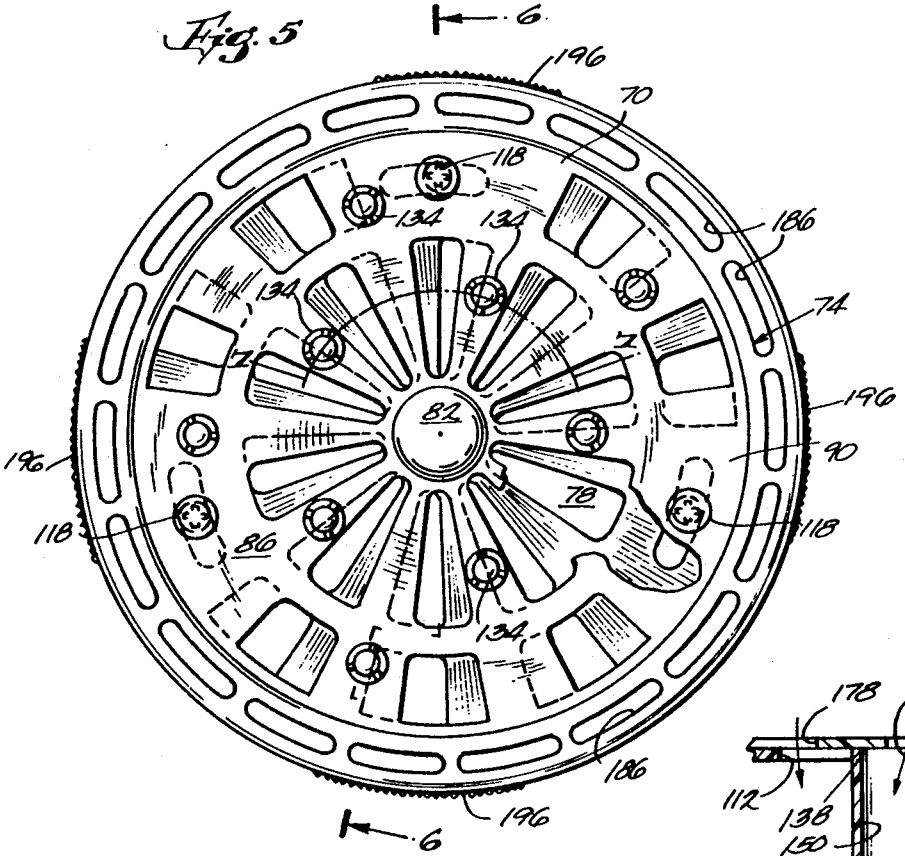
FIG. 5 is a front elevational view, partially broken away for illustration, of the diffuser illustrated by FIG. 2 shown in a second position.

The grill 70 is fixed to the body 22 by a plurality of fasteners 118. As best shown in FIGS. 5 and 6, the fasteners 118 extend through circumferentially spaced fastener holes (not shown) located in the imperforate regions of the grill 70. The fastener holes 122 are aligned with (FIG. 6) an equal number of fastener bosses 126 which extend from the inner surface of the diffuser body 22 and with which the fasteners 118 can be engaged. In the illustrated embodiment, three screws serve as fasteners 118 to fix the grill 70 to the body 22. Preferably, the diffuser 10 also includes a plurality of screw caps 130 (only one shown in FIG. 6) for covering the heads of the screws.

The diffuser 10 also includes a plurality of generally hollow fingers 134 extending from the spokes 110 outwardly of the air passage 50. In the illustrated embodiment of the diffuser 10, the grill 70 includes (FIGS. 2 and 5) five fingers 134 that are located on alternating spokes 110 and that are located radially inwardly of the inner ring 86. The illustrated grill 70 also includes five fingers 134 that are located on alternating spokes 110 radially outwardly of the inner ring 86.

Figure 4:
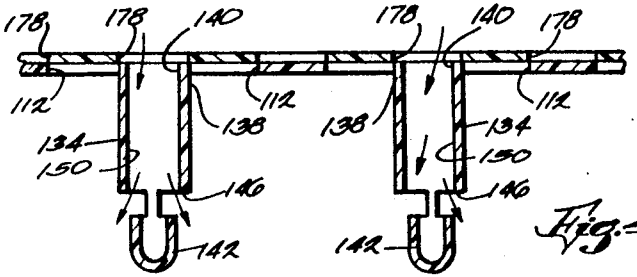
FIG. 4 is a cross-sectional view taken along line 4—4 in FIG. 2.
Figure 7:
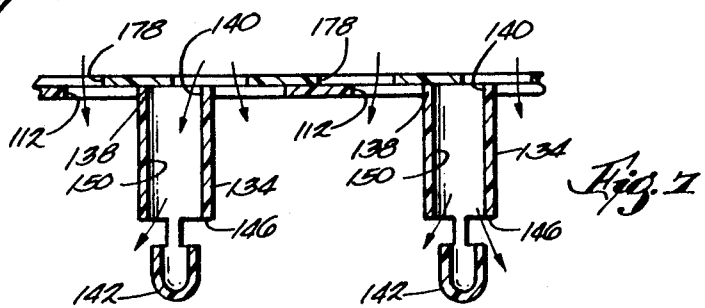
FIG. 7 is a cross-sectional view taken along line 7—7 in FIG. 5.

As best shown in FIGS. 4 and 7, the fingers 134 are generally hollow cylinders having a first end 138 defining a finger passage opening or inlet 140 in the associated spoke 110. Each finger 134 also has a distal, second end 142 extending generally away from the body 22. The distal end 142 of each finger 134 is closed. However, spaced slightly axially inwardly of the end of each finger 134 is a circumferentially extending finger discharge opening 146. A finger passage portion 150 communicates between the finger passage inlet 140 and the finger discharge openings 146. As discussed below, under some conditions, the finger passage portion 150 conducts a portion of the airflow from the air passage 50 in the diffuser body 22 from the finger inlet 140 to the finger discharge openings 146.

The diffuser 10 also includes (FIG. 6) valve means 154 for selectively and adjustably controlling the flow of air from the air passage 50 through the radially inward discharge area 78. In particular, the valve means 154 affords the user of the hair dryer 14 selective and adjustable control of the airflow through the radially inward discharge area 78. The valve means 154 can be operated so that airflow can be alternately directed to the finger discharge openings 146 and the radially inward discharge openings 112 in the grill 70. While various suitable constructions for such the valve means 154 can be used, in the illustrated embodiment, the valve means 154 includes a valve member 158 that is located between the diffuser body 22 and the grill 70.

Figure 1:
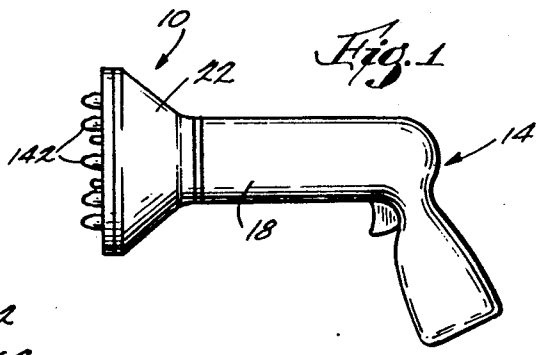
FIG. 1 is a side view of a hair dryer and a diffuser embodying the invention.
Figure 8:
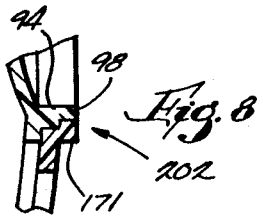
FIG. 8 is an enlarged view of a portion of the diffuser shown in FIG. 6.
Figure 11:
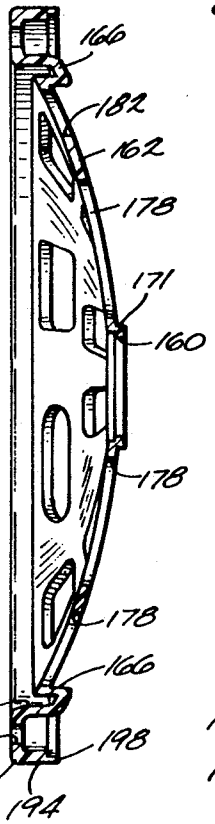
FIG. 11 is a view taken along line 11—11 in FIG. 10.
Figure 10:
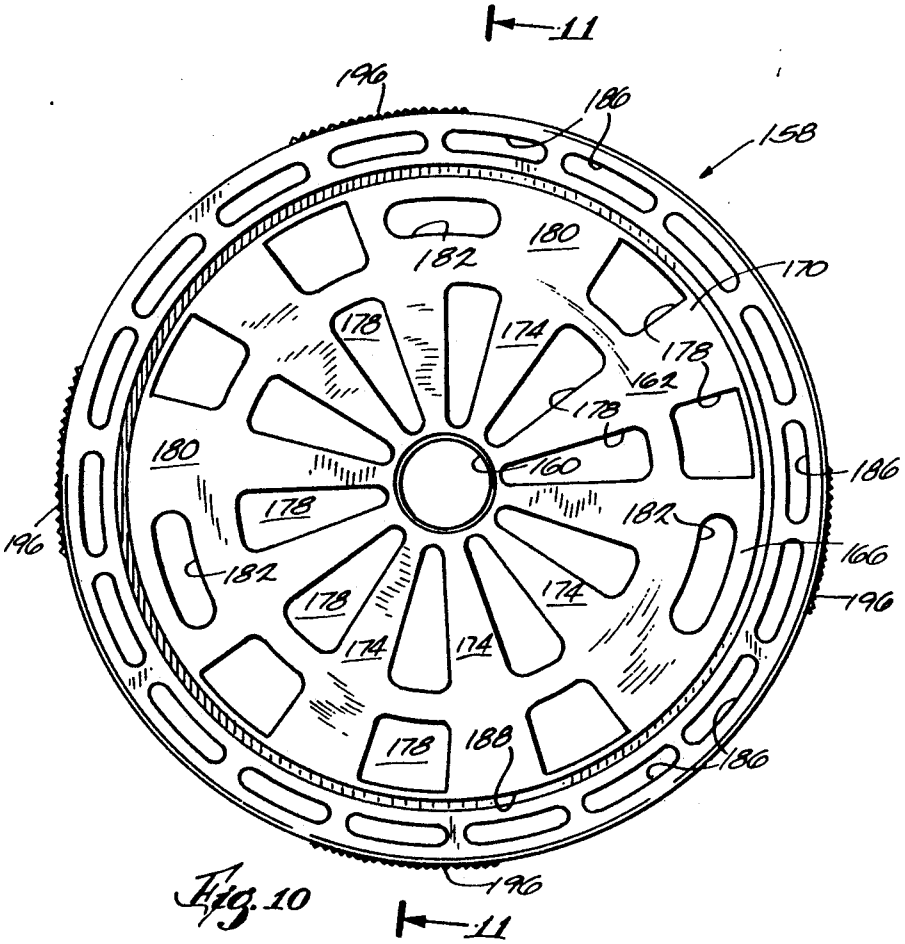
FIG. 10 is a front elevational view of a valve member included in the diffuser shown in FIG. 1.

As best shown in FIGS. 8–11, the valve member 158 includes a centrally located hub 160, inner and outer rings 162, 166 concentrically surrounding the hub 160, and a dish-shaped perforated wall 170 extending between the hub 160 and the inner and outer rings 162, 166. As best illustrated by FIGS. 8 and 11, the hub 160 includes an axially extending cup portion 171 defined by a cylindrical wall having an axially inner end and a radially inwardly turned lip adjacent the inner end. The hub 160 is sized (FIGS. 6 and 8) to receive and house the shank 94 extending from the hub cap 82. For reasons discussed below, the engagement between the hub 160 and the hub cap 82 affords relative rotation therebetween.

The valve member wall 170 includes (FIG. 10) a plurality of louvers 174 extending radially from the hub 160 to the outer ring. The louvers 174 are circumferentially spaced-apart and increase circumferential width with radial distance from the hub 160 in a manner similar to the spokes 110 of the grill 70. Accordingly, the louvers 174 also define radially inward valve openings 178 that are sized and shaped to correspond to the radially inward discharge openings 112 provided by the grill 70.

The valve member 158 also includes a series of imperforate regions 180 that extend between adjacent louvers 174 and between the inner and outer rings 162, 166. The imperforate regions 180 define therein a plurality of circumferentially extending slots 182. When the valve member 158 is assembled with the grill 70 and body 22, the slots 182 (FIG. 5) surround the fasteners 118. Each of the slots 182 has an arc length affording movement of the valve member 158 relative to the fasteners 118 and, therefore, relative to the grill 70 and diffuser body 22 in a manner discussed below. The arc length of the slots 182 is also specific, however, to limit the range of rotation of the valve member 158 relative to the body 22 and the grill 70.

The outer ring 166 of the valve member 158 also provides (FIG. 10) a plurality of circumferentially spaced, radially outward discharge openings 186. The radially outward discharge openings 186 overlie the radially outward discharge area 74 defined by the periphery of the grill 70 and the diffuser body 22 and, therefore, are always open.

Figure 9:
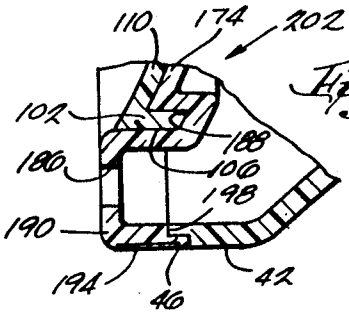
FIG. 9 is an enlarged view of a portion of the diffuser shown in FIG. 6.

As best shown in FIGS. 9 and 11, the outer ring 166 also provides an axially outwardly facing annular groove 188. The groove 188 has a width sufficient to slidingly receive the flange 102 on the outer ring 90 of the grill 70. The outer ring 166 of the valve member 158 also includes a rim 190 providing a second exterior surface 194 that extends about the periphery of the exhaust opening 38. As shown in FIG. 2, the second exterior surface 194 is substantially flush to and adjacent the first exterior surface 42. For reasons discussed below, the second exterior surface 194 has (FIGS. 2 and 3) several circumferentially extending regions 196 of radially extending, raised ribs that facilitate the gripping of the valve member 158 by a user of the hair dryer. Preferably, the first exterior surface 42 on the body 22 is relatively smooth so that the ribbed regions 196 of the valve member 158 are raised from the first outer surface 42 on the body 22.

As best shown in FIG. 9, the rim 190 of the valve member 158 also provides a stepped, axial inner end 198 that is configured to nest with the stepped end 46 of the side wall 26 and to be slidable relative thereto.

The valve means 154 also includes (FIG. 6) means 202 for supporting the valve member 158 for selective movement by the user of the hair dryer 14 relative to the diffuser body 22 and grill 70. While various suitable means can be used for supporting the valve member 158, in the illustrated embodiment such support means 202 includes the rotatable engagement between the hub 160 and the hub cap 82, the slidable engagement of the flange on the grill 70 and the groove 188 in the valve member 158, and the nested, slidable engagement of the stepped rim 190 of the valve member 158 with the stepped end 46 of the side wall 26. These points of slidable contact afford the nested assembly of the diffuser body 22, valve member 158, and grill 70 and permit sliding rotation of the valve member 158 relative to the body 22 and grill 70. In addition, the nested assembly of the body 22, grill 70 and valve member 158 provides a diffuser construction having a pair of elements, i.e. the body 22 and valve member 158, that provide respective exposed exterior surfaces 42, 194. Because the exterior surfaces 42, 194 are exposed when the diffusser is assembled, the user of the diffuser can easily grasp those surfaces and need not reach into the discharged airflow to do so.

The means 202 for supporting the valve member 158 and for affording rotation of valve member 158 relative to the grill 70 and diffuser body 22 also include the slots 182 surrounding the fasteners 118. The slots 182 are arcuate to afford by the user of the diffuser 10 to move or rotate the valve member 158 relative to the fasteners 118 and, therefore, relative to the grill 70 and diffuser body 22.

In particular, the valve member 158 is rotatable between a first, opened position (not shown) and a second, closed position shown in FIGS. 2 and 4. FIGS. 4 and 5 illustrate the valve member 158 in an intermediate position between the opened and closed positions. When in the closed position (FIGS. 2 and 4), the louvers 174 overlie the radially inward discharge openings 112 in the grill 70. Also, when the valve member 158 is in the closed position, the radially inner valve openings 178 overlie the finger inlets 140 and permit portions of the airflow in the diffuser passage to pass into the finger discharge passage portions 150 and out the finger discharge openings 146.

As noted above, the radially outer discharge openings 186 in the valve member 158 are not valved, i.e., they are always open, and therefore also permit passage of a portion of the airflow from the diffuser air passage 50 to exit the diffuser 10 when the valve member 158 is in the closed position.

When the valve member 158 is moved toward the open position (FIGS. 5 and 6), the valve openings 178 overlie, to an increasing extent, the radially inward discharge openings 112 in the grill 70 and permit a portion of the airflow to pass therethrough from the diffuser air passage 50. Also, when the valve member 158 is moved toward the opened position, the louvers 174 overlie, to an increasing extent, the finger inlets 140 thereby decreasing the amount of airflow that enters the finger passage portions 150. As a result of the increasing opening of the radially inner discharge openings 112 and the decreasing opening of the finger inlets 140 as the valve member 158 moves toward the opened position, rotation of the valve member 158 between the opened and closed positions controls the amount of airflow respectively passing through the radially inward discharge openings 112 and the finger passage portions 150 in an inverse proportion.

As mentioned above, the slots 182 in the valve member 158 limit the range of rotation of the valve member between the open and closed positions so that, for example, the valve member 158 cannot be rotated beyond the closed position (clockwise in FIG. 2) to permit air flow through the valve openings 178 and discharge openings 112.

Because the second external surface 194 of the valve member 158 is exposed and easily graspable when the diffuser 10 is assembled, and due to the construction affording movement of the valve member 158 relative to the grill 70 and diffuser body 22, the diffuser 10 thus provides means for affording selective movement by a user of the diffuser 10 of the second external surface 194 relative to the first external surface of the diffuser body 22. Such an arrangement affords adjustment by the user of the diffuser discharge without having to reach into the discharged air flow.

Various additional features of the invention are set forth in the following claims.

We claim:

1. A diffuser for a hair dryer having an air discharge nozzle, said diffuser comprising a body having a side wall defining a first opening adapted to communicate with the air discharge nozzle of the hair dryer and a second opening, said body defining an air passage communicable between said first and second openings for conducting therebetween an air flow, a grill overlying said second opening and defining a plurality of discharge openings, a plurality of generally hollow fingers extending from said grill outwardly of said air passage, said fingers defining respective finger discharge openings and respective finger discharge passage portions communicable between said air passage and said finger discharge openings, and valve means for selectively and adjustably controlling the flow of air from said air passage through said discharge openings and said finger discharge openings.

2. A diffuser as set forth in claim 1 wherein said grill is spaced from said second opening and wherein said grill and said side wall define therebetween an open radially outward peripheral discharge opening.

3. A diffuser as set froth in claim claim 1 wherein said valve means includes a valve member supported by said grill and said body.

4. A diffuser as set forth in claim 3 wherein said grill and said body support said valve member for movement relative thereto.

5. A diffuser as set forth in claim 1 wherein said valve means includes a valve member having an exterior peripheral surface that is flush with said side wall adjacent said second opening.

6. A diffuser as set forth in claim 1 wherein said valve means includes means for controlling the flow of air from said air passage through said discharge openings and said finger discharge openings in inverse proportion.

7. A diffuser as set forth in claim 6 wherein said grill and said body define therebetween a radially outward peripheral discharge opening that is always open.

8. A diffuser for a hair dryer having an air discharge nozzle, said diffuser comprising a body adapted to be supported on the air discharge nozzle of the hair dryer and having a central axis and a side wall defining an opening and including a first annular exterior surface adjacent said opening, a grill fixed to said body, extending across said opening, and having a perimeter spaced radially inwardly from said first annular exterior surface, a valve member located between said body and said grill, movable relative to said grill about said axis and between open and closed positions, and including a portion extending between said perimeter of said grill and said first exterior surface and providing a second annular exterior surface flush with and axially adjacent said first exterior surface and adapted to be gripped by a user of the hair dryer, and means for supporting said valve member to afford selective relative movement by the user of said second exterior surface relative to said first exterior surface.

9. A diffuser as set forth in claim 8 wherein said grill defines a radially inward valves discharge area and wherein said second exterior surface surrounds said valved discharge area.

10. A diffuser for a hair dryer having an air discharge nozzle, said diffuser comprising a body adapted to be supported on the air discharge nozzle of the hair dryer and having a side wall defining an opening and a first exterior surface adjacent said opening, a grill fixed to said body by a plurality of fasteners and extending across said opening, a valve member located between said body and said grill, defining therein a plurality of slots surrounding said fasteners, and providing a second exterior surface flush to and adjacent said first exterior surface and adapted to be gripped by a user of the hair dryer, and means for supporting said valve member to afford selective relative movement by the user of said second exterior surface relative to said first exterior surface.

11. A diffuser as set forth in claim 10 wherein said body has a central axis, and wherein said valve member is rotatable about said axis relative to said body and said grill.

12. A diffuser for a hair dryer having an air discharge nozzle, said diffuser comprising a body having an open end and an air passage communicable with the air discharge nozzle of the hair dryer for conducting an air flow to said open end, a grill overlying said open end and including a plurality of spokes defining therebetween a plurality of air discharge openings, a plurality of generally hollow fingers on the grill and extending outwardly of said air passage, each finger having a finger discharge opening and a discharge passage portion communicable between said air passage and said finger discharge opening for conducting a portion of said air flow, and valve means located between said body and said grill for selectively and adjustably controlling the air flow through said fingers.

13. A diffuser as set forth in claim 12 wherein said valve means includes means for controlling the air flow through said finger discharge openings.

14. A diffuser as set forth in claim 13 wherein said valve means includes means for controlling the air flow through said air discharge openings and through said fingers in inverse proportion.

15. A diffuser as set forth in claim 14 wherein said body and said grill define therebetween a peripheral radially outward discharge opening that is always open.

16. A diffuser as set forth in claim 12 wherein said valve means includes a valve member and means for supporting said valve member for movement between open and closed positions.

17. A diffuser as set forth in claim 16 wherein said valve member is movable relative to said body and said grill.

18. A diffuser as set forth in claim 17 wherein said grill is fixed to said body by a plurality of fasteners, and wherein said valve member defines a plurality of slots surrounding said fasteners.

* * * * *